US005462286A

United States Patent [19]

Roberts

[11] Patent Number: 5,462,286

[45] Date of Patent: Oct. 31, 1995

[54] AMUSEMENT DEVICE

[76] Inventor: Edward Roberts, 473 Maple St., Weldon, Ill. 61882

[21] Appl. No.: 377,470

[22] Filed: Jan. 24, 1995

[51] Int. Cl.[6] ..... A63F 9/00

[52] U.S. Cl. ..... 273/459; 194/338; 453/9

[58] Field of Search ..... 273/459, 138 R, 273/138 A; 453/6, 9; 194/334, 338

[56] References Cited

U.S. PATENT DOCUMENTS

| | | | |
|---|---|---|---|
| 446,303 | 2/1891 | Thompson | 453/9 X |
| 4,773,648 | 9/1988 | Itoh | 194/338 X |
| 5,139,129 | 8/1992 | DiLuciano | 194/338 |
| 5,297,816 | 3/1994 | Becchio | 273/138 A X |

FOREIGN PATENT DOCUMENTS

| | | | |
|---|---|---|---|
| 595982 | 7/1925 | France | 194/338 |
| 92220 | 5/1897 | Germany | 194/338 |

*Primary Examiner*—Paul E. Shapiro
*Attorney, Agent, or Firm*—Philip L. Bateman

[57] ABSTRACT

An amusement device contains a playing area housed inside a cabinet which is visible from outside the cabinet. The device contains a coin feeder which allows only coins of a particular size to pass and to drop down into the playing area. The playing area contains at least one horizontal platform positioned in the playing area so that the coins dropping down from the coin feeder land on the platform. The coins landing on the platform accumulate in a random pile and occasionally spill over the platform and a portion of them are discharged to the player.

5 Claims, 3 Drawing Sheets

2E

AMUSEMENT DEVICE

FIELD OF THE INVENTION

This invention relates to amusement devices. More particularly, this invention relates to coin-operated amusement devices which operate primarily by chance.

BACKGROUND OF THE INVENTION

Coin-operated amusement devices are popular at charitable events, fairs, arcades, and casinos. In some types of devices, the player is given an opportunity to play a game which is based primarily on skill. If the player performs well, he is rewarded with an opportunity to play again, a prize, or other merchandise. Examples of such devices include pinball, video games, basketball-shooting games, etc.

Other types of amusement devices are based primarily on chance and the player typically has the opportunity to be rewarded with prizes or money. Examples of such coin-operated amusement devices include those shown in Barnard, U.S. Pat. No. 1,937,500, issued Dec. 5, 1933; Pocell, U.S. Pat. No. 2,135,292, issued Nov. 1, 1938; Bawden, U.S. Pat. No. 2,482,893, issued Sep. 27, 1949; and Deglau, U.S. Pat. No. 5,176,238, issued Jan. 5, 1993. One of the most popular amusement devices of this type is the slot machine. A slot machine is played by inserting a coin into the machine, pulling a lever to rotate a series of wheels, and then waiting to see if the wheels come to rest in a particular alignment. If they do, a number of coins from inside the machine are discharged to the player. If the wheels do not come to rest in alignment, no coins are discharged. Slot machines are staple items wherever gambling is allowed. Slot machines are also very popular for personal use and for use in raising money for charity.

While slot machines and various other types of coin-operated amusement devices have been popular for many years, it would be desirable to provide such a device which is more attractive to the player, to potential players, and to spectators.

SUMMARY OF THE INVENTION

The general object of this invention is to provide an improved amusement device. A more particular object is to provide a coin-operated amusement device in which a playing area containing coins is visible to the players. Another more particular object is to provide a coin-operated amusement device which is attractive to play because the player can see when coins are likely to be discharged.

I have invented an improved amusement device comprising: (a) a cabinet having a front face, a back face, two side faces, and a top; the upper interior portion of the cabinet defining a playing area with a floor; at least one face of the cabinet having a transparent portion enabling the playing area to be seen from outside the front of the cabinet; (b) a coin feeder above the playing area which allows only coins of a particular size to pass and to drop down into the playing area; (c) at least one horizontal platform positioned in the playing area above the floor and under the coin feeder so that coins dropping down from the coin feeder land on the platform, accumulate in a random pile on the platform, and occasionally spill over the platform and land on the floor of the playing area; and (d) a means for discharging at least a portion of the coins landing on the floor of the playing area to the outside of the cabinet.

This amusement device is attractive to players, potential players, and spectators because the playing area containing the coins can be seen. The playing area shows the large number of coins which are likely to be discharged and also shows when the coins are likely to be discharged.

DETAILED DESCRIPTION OF THE INVENTION

Figure 1:
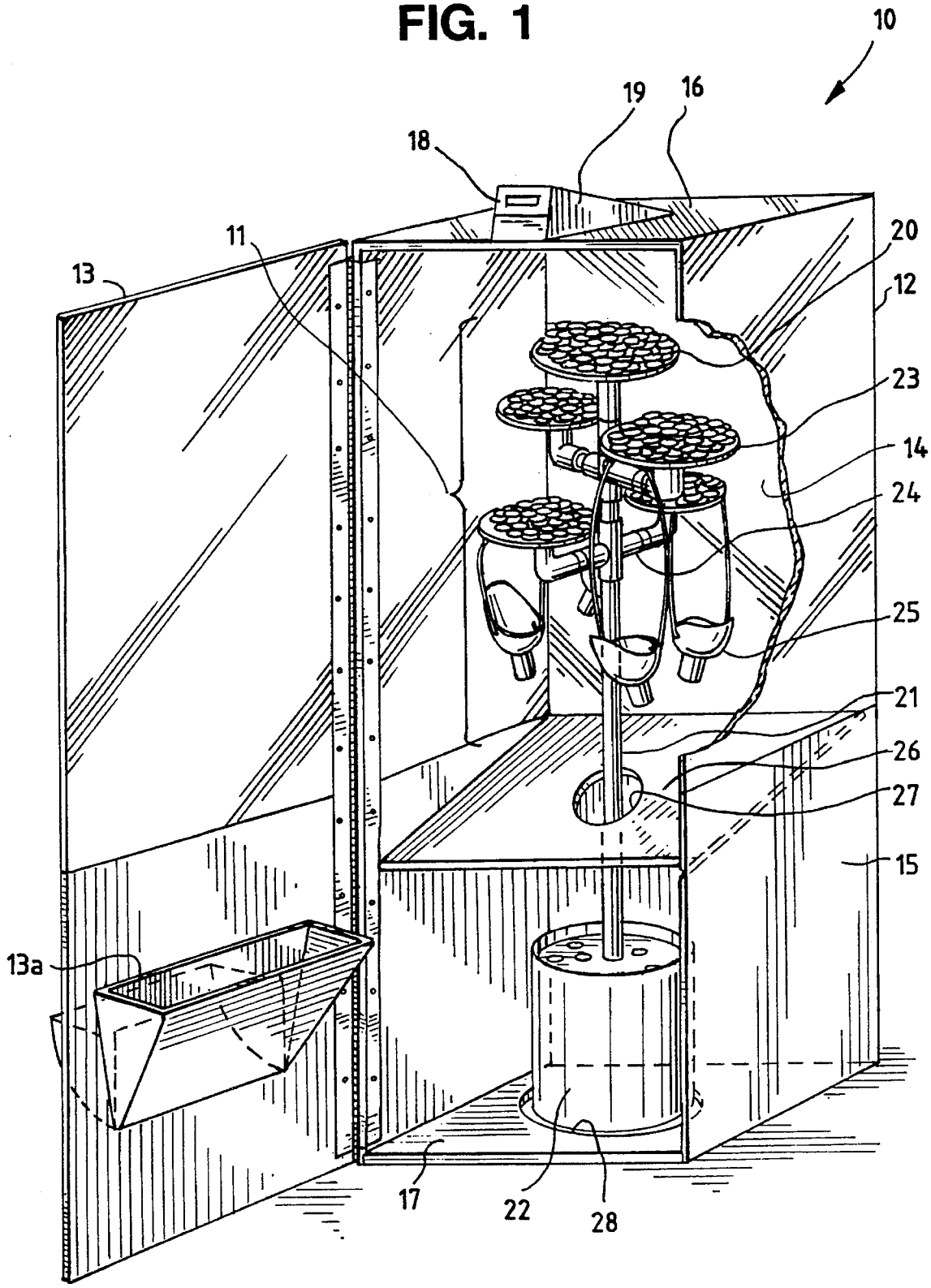
FIG. 1 is a perspective view of one embodiment of the amusement device of this invention.

This invention is best understood by reference to the drawings. In FIG. 1, one embodiment of the amusement device 10 of this invention is shown. The upper portion of the device defines a playing area 11 which, as will be seen, is visible to the person playing the device. The playing area is housed inside a cabinet 12 so the player cannot touch or interfere with the playing area.

The cabinet contains a front face 13 consisting of a hinged front door which is shown in the open position for illustration purposes. The front door is normally closed and locked. The front door of the FIG. 1 embodiment has an upper portion made of plexiglass, hardened glass, or other durable and transparent material so the playing area can be seen from outside the cabinet. The transparent portion is, alternatively, a window built into the door. The lower portion of the door is preferably made of a durable and opaque material such as wood, plastic, metal, or even plexiglass which has been painted or covered. A coin receiver 13*a* running most of the width of the door is located in the front door. A slot (not shown) is located in the door at the bottom of the coin receiver. As explained below, coins are discharged to the player through the slot and into a collection tray (not shown) on the outside of the door.

The cabinet also contains a back face 14, two side faces 15, a top 16, and a bottom 17, all of which are constructed of a durable material such as plexiglass, wood, plastic, metal, or a combination thereof. In the FIG. 1 embodiment, the upper portions of the side faces are made of plexiglass so the playing area can also be seen from the sides. The size and location of the transparent portion(s) in the cabinet are a matter of choice: The only requirement is that the cabinet contain at least one transparent portion of a size sufficient to enable the player to see the playing area. In general, the amusement device becomes more attractive to players as the amount of transparent area increases. If desired, the entire upper portion of the cabinet can be transparent as is shown in the FIG. 1 embodiment.

The cabinet is preferably mounted securely to the surface on which it sits and/or to a wall, vertical post, or the like against which it rests so that it cannot be moved or rocked. As explained below, excessive rocking may seriously interfere with the operation of the amusement device. When the cabinet is mounted to a floor, the bottom is often omitted because the floor itself functions as the bottom. Similarly, one or more vertical faces can be omitted if the cabinet is mounted to a wall. The important factor is that a player not be able to interfere with the playing area.

The overall dimensions of a floor-mounted cabinet are approximately 4 feet high by 18 inches wide by 18 inches deep. A smaller device having cabinet dimensions of approximately 2×1×1 feet is suitable for use on tables while much larger devices are suitable for special effect at casinos and the like. For example, a 20-foot-high amusement device reaching a ceiling or an overhanging balcony creates a stunning sight for players, potential players, and spectators.

The amusement device is operated by inserting a coin into a coin feeder. The coin passes through the coin feeder and then drops down by gravity into the playing area. The simplest coin feeder is an opening in the top face of the cabinet. This type of coin feeder is suitable for home use where the control of coin size is not a problem. However, most amusement devices intended for public use contain coin feeders which permit only certain types of coins to enter the playing area, whether it be nickels, dimes, quarters, half dollars, or some combination thereof. A wide variety of coin feeders which permit only coins of a desired size to enter a device are known to the art and are used in vending machines, parking meters, etc. These types of coin feeders are generally suitable for use in the amusement device of this invention.

Figure 2A:
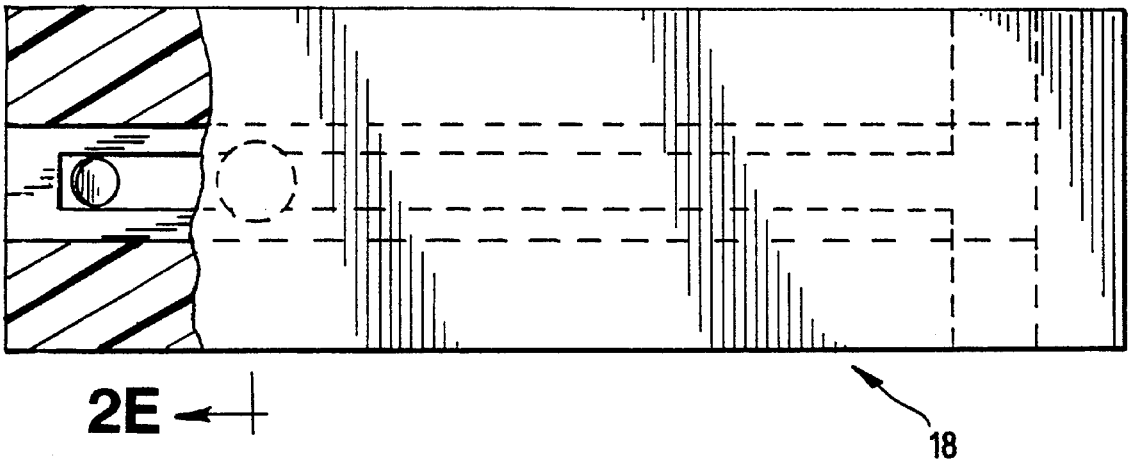
FIG. 2A is a top view, partially in section, of the coin feeder component of the amusement device shown in FIG. 1.
Figure 2B:
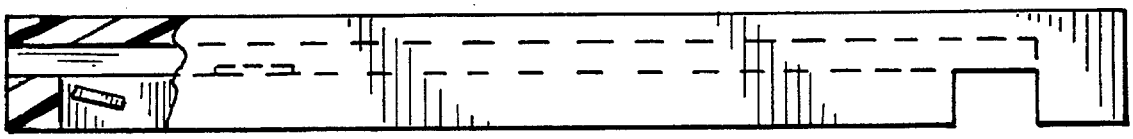
FIG. 2B is a side view of the coin feeder component.
Figure 2C:
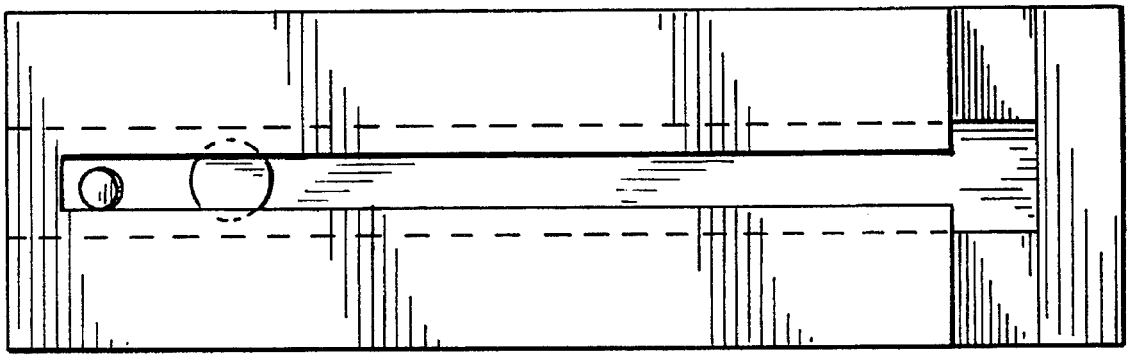
FIG. 2C is a bottom view of the coin feeder component.
Figure 2D:
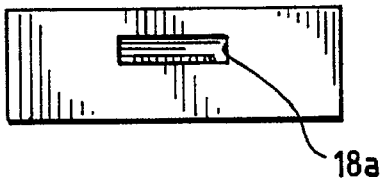
FIG. 2D is a front view of the coin feeder component.
Figure 2E:
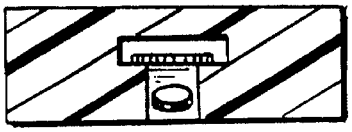
FIG. 2E is a sectional view of the coin feeder component taken along the line indicated in FIG. 1.
Figure 2F:
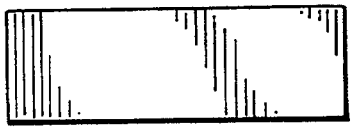
FIG. 2F is a rear view of the coin feeder component.

A preferred coin feeder 18 is shown mounted in an enclosure 19 which is removably secured to the top of the cabinet. The enclosure slopes downwardly from front to back at an angle of about 30° to the horizontal. The coin feeder itself is shown in detail in FIGS. 2A–2F. The coin feeder is a body in the general shape of a rectangular prism. The coin feeder contains a slot 18*a* in its front face adapted to receive coins of a particular size. The slot is just barely larger than the diameter of the desired coins so larger coins cannot be inserted. The slot communicates with a passage running all or, as shown in FIG. 2A, most of the length of the coin feeder. An open channel runs along the bottom of the passage, as seen best in FIG. 2C. The width of the channel is just slightly less than the diameter of the desired coin so that smaller coins drop through the channel before reaching the end of the passage. In FIGS. 2A–2E, two coins are shown: one coin of the desired type is retained in the channel while another smaller and undesired coin has fallen through the channel. These smaller coins are retrieved periodically by removing the enclosure from the top of the cabinet. Coins of the desired size, in contrast, slide down to the end of the passage and then drop down into the playing area through a hole in the top of the cabinet. The hole is not seen in FIG. 1 because it is covered by the enclosure.

In any event, a coin drops down into the playing area where it lands on a horizontal platform 20. The platform shown in FIG. 1 is circular in shape, has a diameter of about 6 inches, and is relatively flat on its top surface without any lip or retaining wall around the circumference. The shape and size of the platform is a matter of choice, although a circular shape is preferred because coins tend to spill over equally around its perimeter. The platform is conveniently supported by shaft 21 which is mounted in a weighted bucket 22. The embodiment shown in FIG. 1 is constructed by filling a bucket with wet cement, inserting the shaft into the middle, and holding it in a vertical portion until the cement hardens. The procedure is similar to the one commonly used to mount fence posts and the like into the ground. It can be seen that the bucket-shaft-platform assembly is independent of the cabinet so that slight rocking of the cabinet does not disturb the platform and other components attached to the shaft. Other supporting means for the platform are suitable, provided the platform is insulated from movement.

It is desired that coins stack randomly on the platform and spill over at irregular accumulations. Accordingly, the platform is sufficiently horizontal that the coins do not slide off when they land. The irregularity with which the coins stack and spill over, combined with the observable nature, creates a heightened interest in the game. When the coins build up into a large stack, each player thinks the coin he inserts will be the one which will cause a large spillover. For a given diameter of platform, various modifications are possible to increase the size of the coin stack which will accumulate without spilling. For example, employing a cupped (i.e., concave) platform, adding a non-skid surface such as rubber to the top of the platform, and/or adding a lip or wall around the circumference increases the size of the stack which will form.

While a single horizontal platform generates considerable interest in the game, additional horizontal platforms create even more interest. The device shown in FIG. 1 contains one primary platform at an upper level and four secondary platforms 23 distributed at equal 90° radial intervals around and below the primary platform. The radial distribution of the secondary platforms is shown most clearly in FIG. 3. The secondary platforms are located so they are partially overlapped by the primary platform, thus ensuring that a portion of the coins spilling over from the main platform sometimes land on the secondary platforms. In the embodiment shown, the secondary platforms are arranged so that almost all the coins falling from the primary platform land on a secondary platform. The secondary platforms are conveniently supported by arms 24 extending from the shaft. In the embodiment shown in FIG. 1, each secondary platform is at the same level as an opposing secondary platform positioned 180° about the shaft. This arrangement is visually appealing and also balances the shaft. The number of secondary platforms is a matter of choice. Two to eight secondary platforms are preferred in a floor-mounted device having a height of about four feet. As the size of the cabinet increases, the number of secondary platforms preferably increases as well.

Additional interest in the amusement device is created by the addition of a series of weighted cups 25 to the playing area. One of the cups is shown in detail in FIG. 4. A suitable cup is made by cutting a 16-ounce plastic soft drink bottle at an angle as shown, securing a weight of about one-half ounce in the neck portion, and suspending the cup with two strings or wires attached to an overhead horizontal platform or other location. The open end of the cup faces upward and receives coins dropping down from above. As the number of coins in the cup increases, the cup begins to tip. At some weight, the cup completely flips and all or most of the coins fall out. The cup shown in FIG. 4 tips at a load of about 10 to 60 quarters. The weight at which the cup flips is a function of the size and shape of the cup, of the amount of weight in the neck, of the angle of the cut, and of the location of the points of attachment of the strings or wires. The location of the cups in the embodiment shown is seen most clearly in FIG. 3. It can be seen that only a minor portion of the coins spilling over from the horizontal platforms land in the cups.

The number and location of the cups is a matter of choice provided they are located where they receive coins falling from above.

The floor 26 of the playing area is preferably constructed so that at least a portion of the coins landing on the floor are discharged to the player. As shown in FIG. 1, one suitable method of construction is to slope the floor so that the coins slide down to the outlet slot in the front door where they are discharged to the player. A slope of about 30° to the horizontal is adequate to ensure the coins slide down the floor. The floor also preferably contains an opening 27 through which a portion of the coins fall and accumulate in a coin receiver. As previously mentioned, the opening in the floor serves the additional purpose of insulating the shaft from vibrations of the cabinet (as does the opening 28 in the bottom of the cabinet). Coins accumulating in the coin receiver are emptied periodically and constitute the gross profit made by the owner of the amusement device. The weighted bucket supporting the shaft functions as the coin receiver in the embodiment shown in FIG. 1. The coin receiver is conveniently located in the space between the floor of the playing area and the bottom of the cabinet where it is out of sight. The bottom of the cabinet itself can function as the coin receiver if a separate container is not desired. A locked door or the like is used to control access to the coin receiver. It can be seen that the ratio of the number of coins returning to the player to the number of coins going to the coin receiver is variable and is adjusted by the size, shape, and location of the openings. Other means are available to separate the coins into two or more portions. A device intended for home use only typically returns all the coins landing on the floor to the player.

A variety of other visual and/or aural elements are conveniently added to the amusement device to create additional interest. Examples of such elements are lights, mirrors, bright colors and graphics, music, and the like.

Figure 3:
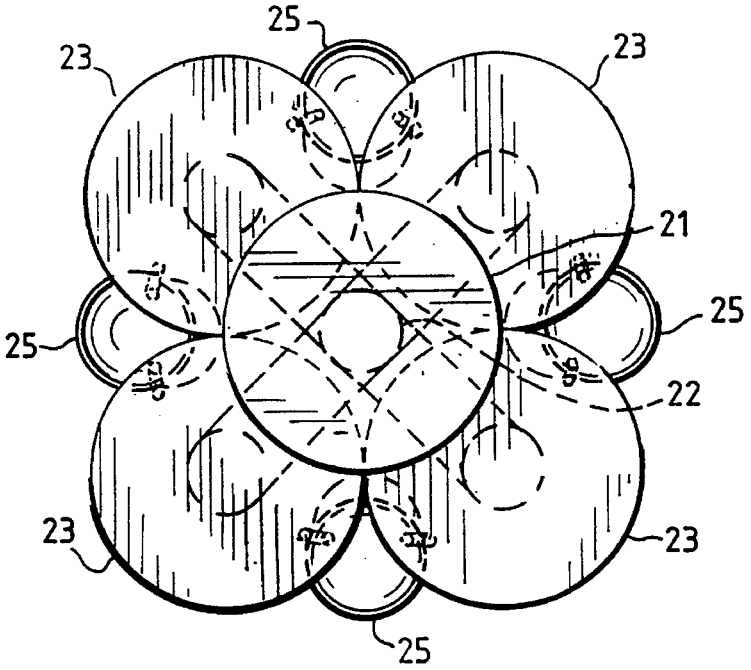
FIG. 3 is a top view of the playing area of the amusement device shown in FIG. 1.
Figure 4:
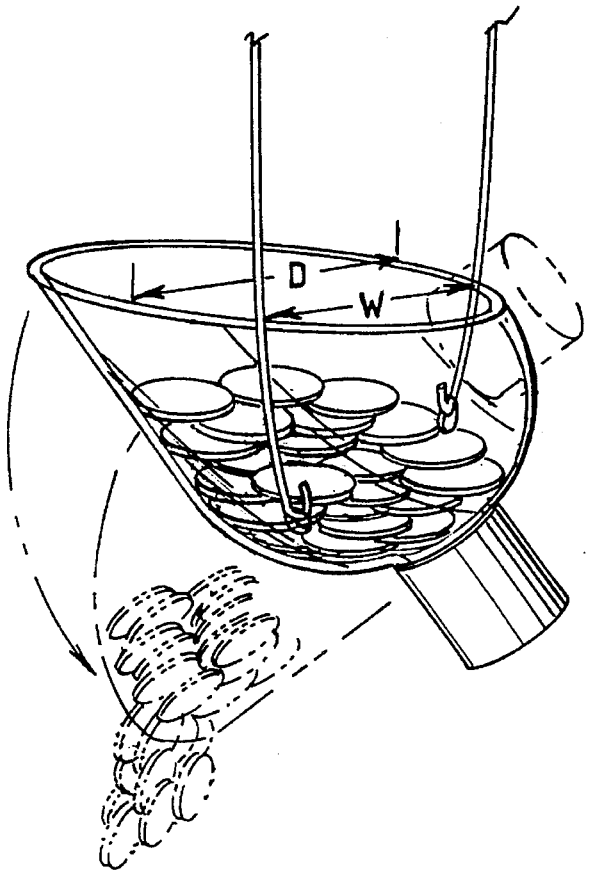
FIG. 4 is a detailed perspective view one of the cups shown in FIG. 1.

When the amusement device of this invention is first placed into service, the platform(s) should be at least partially loaded with coins. Without this pre-loading, it is unlikely that players would begin playing the device because they would see that the initial coins would probably stack on a platform rather than spilling over. During play, the platforms of the amusement device are covered with coins and the cups generally contain coins as well, unless they have just recently tipped. In FIG. 1, coins are shown on the platforms, but not in the cups for illustration purposes only. In FIG. 3, coins are not shown in the cups or on the platforms, again for illustration purposes only.

I claim:

1. An amusement device comprising:

(a) a cabinet having a front face, a back face, two side faces, and a top; the upper interior portion of the cabinet defining a playing area with a floor; at least one face of the cabinet having a transparent portion enabling the playing area to be seen from outside the front of the cabinet;

(b) a coin feeder above the playing area which allows only coins of a particular size to pass and to drop down into the playing area;

(c) at least one horizontal platform positioned in the playing area above the floor and under the coin feeder so that coins dropping down from the coin feeder land on the platform, accumulate in a random pile on the platform, and occasionally spill over the platform and land on the floor of the playing area;

(d) a means for discharging at least a portion of the coins landing on the floor of the playing area to the outside of the cabinet; and (e) at least on cup suspended in a tilting orientation below a horizontal platform and above the floor, the cup being adapted to receive and hold coins dropping from the platform, the cup being further adapted to tilt over and spill the coins down onto the floor when the coins in cup reach a certain number.

2. The amusement device of claim 1 comprising at least three horizontal platforms wherein one platform is positioned at the highest level and the other platforms are positioned at lower levels and in overlapping relationship with the highest platform so that coins spilling over from the highest platform land on the other platforms.

3. The amusement device of claim 2 wherein the coin feeder comprises a body having a downwardly sloping passage with an entrance and an exit through which coins of the desired size slide, the opening of the passage having a size which prevents coins larger than the desired size to enter, the exit of the passage communicating with the playing area, and the passage having an opening along its bottom of a size which enables coins smaller than the desired size to fall through before reaching the exit.

4. The amusement device of claim 3 wherein the lower platforms are equally spaced radially.

5. The amusement device of claim 4 wherein a plurality of cups are positioned below the lower platforms.

* * * * *